US006258420B1

(12) United States Patent
Lehman

(10) Patent No.: US 6,258,420 B1
(45) Date of Patent: Jul. 10, 2001

(54) TWISTED SPIRAL GARLAND

(75) Inventor: William L. Lehman, Whitelaw, WI (US)

(73) Assignee: Santa's Best, Northfield, IL (US)

( * ) Notice: Subject to any disclaimer, the term of this patent is extended or adjusted under 35 U.S.C. 154(b) by 0 days.

(21) Appl. No.: 09/444,228

(22) Filed: Nov. 19, 1999

(51) Int. Cl.[7] ..... A47G 33/04

(52) U.S. Cl. ..... 428/7; 428/4; 428/5; 428/10; 428/98; 428/222; 428/371

(58) Field of Search ..... 428/10, 5, 222, 428/371, 98, 4, 7; 57/203, 24; 156/148, 425, 431; 493/958, 346; D11/119, 120, 121

(56) References Cited

U.S. PATENT DOCUMENTS

| | | | |
|---|---|---|---|
| 60,013 | 11/1866 | King . | |
| 1,994,926 | 3/1935 | Schlegel . | |
| 2,304,281 | 12/1942 | Riley . | |
| 2,851,715 | 9/1958 | Goodloe . | |
| 3,453,170 | 7/1969 | Jason . | |
| 3,484,329 | 12/1969 | Boisse . | |
| 3,732,679 | 5/1973 | Sohr | 57/34 |
| 3,832,841 | 9/1974 | Cole | 57/152 |
| 4,148,178 | 4/1979 | Raschle | 57/264 |
| 4,575,472 | 3/1986 | Lefferts | 428/222 |
| 4,789,571 | 12/1988 | Kinderman et al. | 428/10 |
| 4,957,784 | 9/1990 | Ripamonti | 428/5 |
| 5,183,442 | 2/1993 | Lefferts | 474/239 |
| 5,201,699 | 4/1993 | Protz, Jr. | 493/346 |
| 5,589,238 | 12/1996 | Ruff | 428/10 |

*Primary Examiner*—Deborah Jones
*Assistant Examiner*—Abraham Bahta
(74) *Attorney, Agent, or Firm*—Emrich & Dithmar

(57) ABSTRACT

A decorative twisted spiral garland includes one or more continuous webs of material, each arranged in a series of flattened, generally helical coils about a longitudinal axis, with the coils extending generally transversely of the axis and having a predetermined pitch longitudinally of the axis, and a pair of wires extending generally parallel to the axis outside of the coils and respectively along opposite sides of the coils, the wires being twisted together along the axis so that the coils are pinched together along the axis and twisted about the axis. The actual shape of the garland depends upon the amount of twist imparted to the wires and coils. One or more filaments may also be disposed along the axis inside the coils and twisted together with the wires and the coils.

33 Claims, 2 Drawing Sheets

FIG. 1
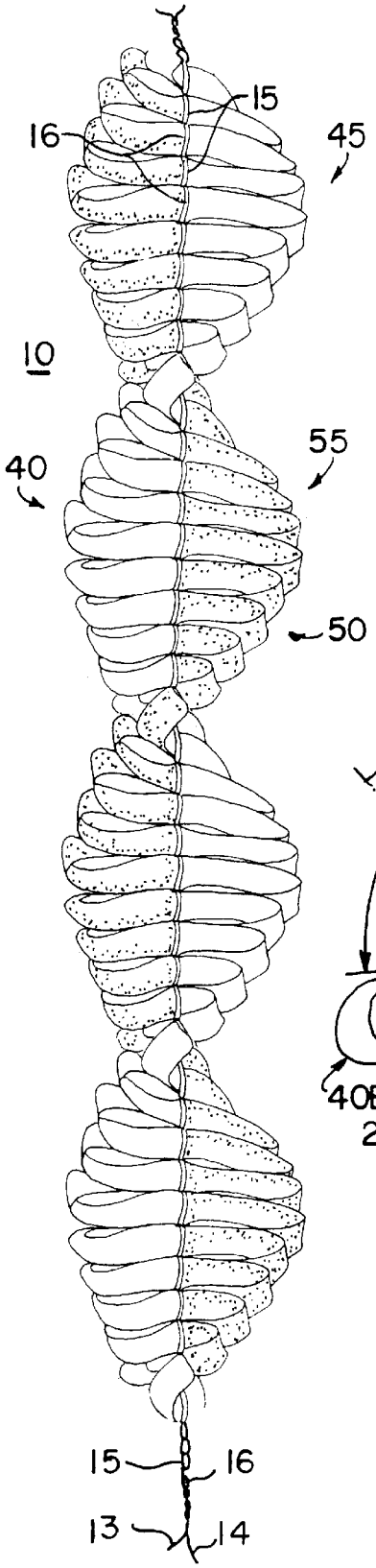
FIG. 2
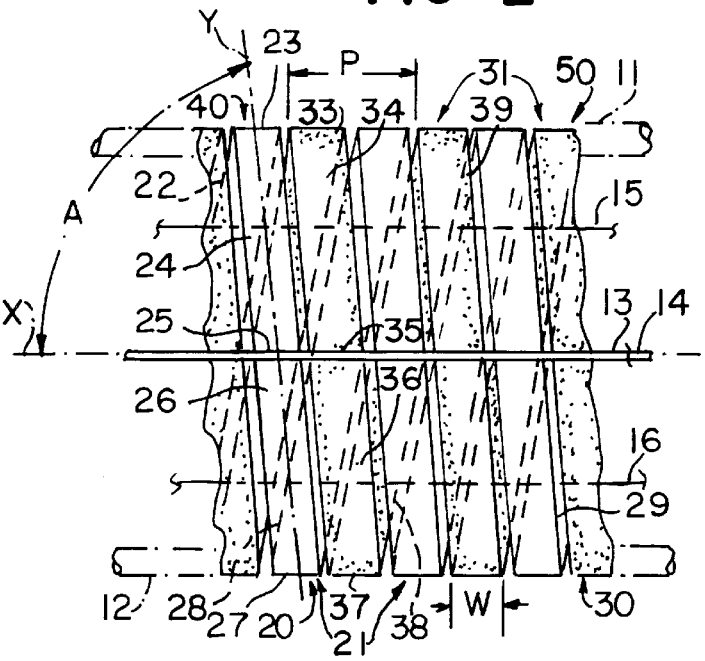
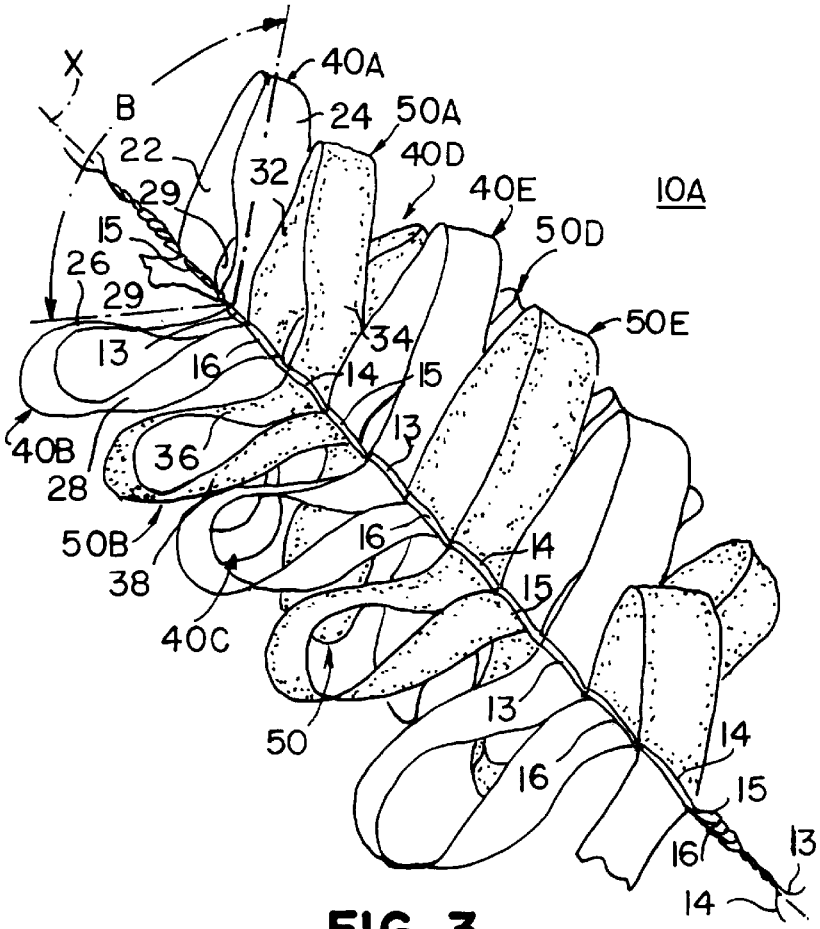
FIG. 3

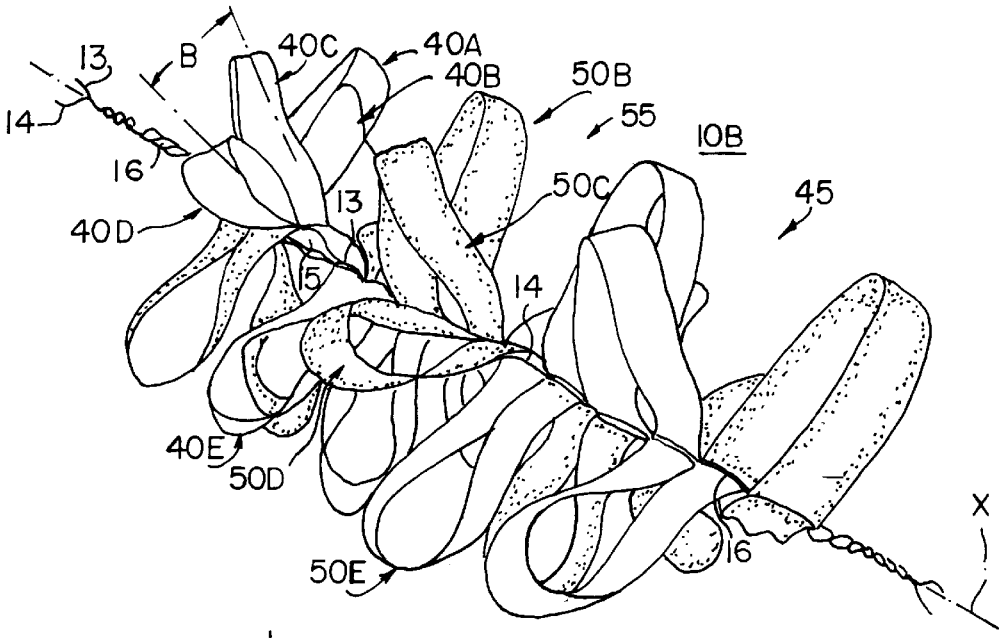
FIG. 4
FIG. 5
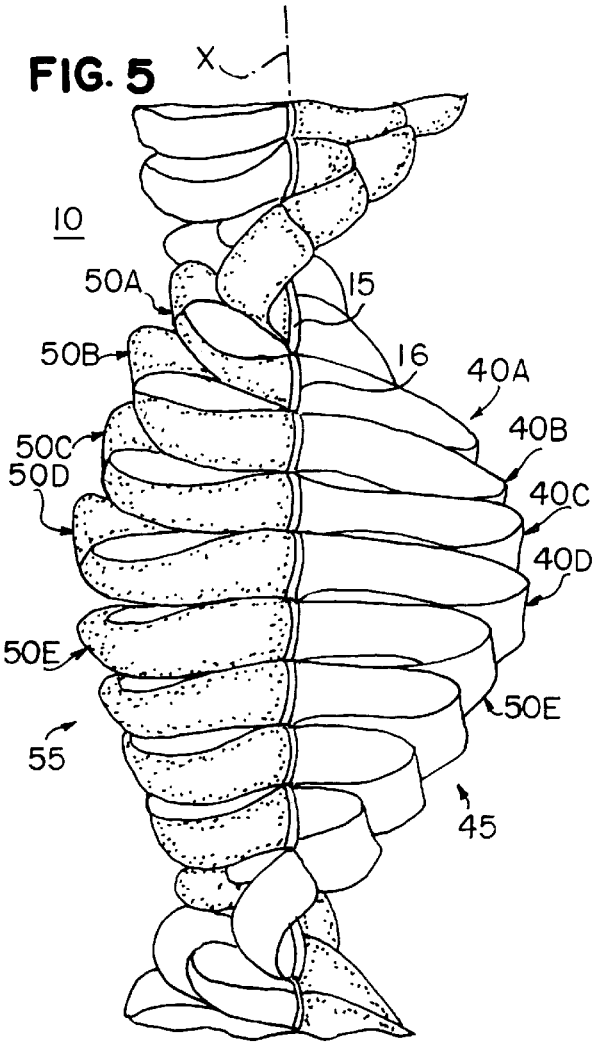
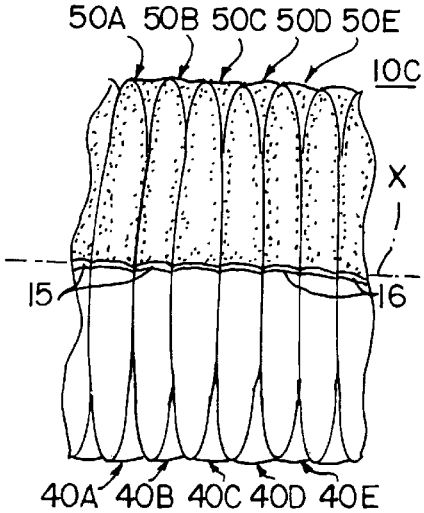
FIG. 6

TWISTED SPIRAL GARLAND

BACKGROUND OF THE INVENTION

The present invention relates to decorative garlands of the type commonly used for decorating Christmas trees, wreaths, and the like, and which may be suspended from ceilings, attached to walls and used as decorations in connection with other objects and structures.

Prior garlands have been made of a variety of types of materials and in a variety of different shapes and designs. Many such garlands are formed by twisting or rotating together materials which have been preprocessed in a specialized way, such as cutting to predetermined shapes or the like, such preprocessing adding considerably to the expense of the garland. Other garlands, formed of readily available raw materials which have not been preprocessed, have resulted in garlands which either have a tight rope-like design or otherwise present a non-unique appearance.

SUMMARY OF THE INVENTION

It is a general object of the invention to provide an improved decorative garland which avoids the disadvantages of prior garlands, while affording additional structural and operational advantages.

An important feature of the invention is the provision of a decorative garland which can be formed of readily commercially available materials, without any preprocessing of the materials.

Another feature of the invention is the provision of a garland of the type set forth, which is of relatively simple and economical construction.

Another feature of the invention is the provision of a garland of the type set forth, which presents a unique decorative appearance.

In connection with the foregoing feature, a further feature of the invention is the provision of a garland of the type set forth which has a twisted configuration, and which can be formed in a variety of significantly different finished appearances by variation of the amount of twist imparted to the garland.

Certain ones of these and other features of the invention may be attained by providing a decorative garland comprising: a pair of elongated core wires twisted together along a longitudinal axis, and a continuous web of material arranged in a series of consecutive portions extending longitudinally of the web, with each portion inclined with respect to the axis at a predetermined acute angle, each portion having an inner end disposed adjacent to the axis and an outer end spaced radially from the axis, the web being disposed between the wires at each of the inner ends, each web portion having a leading side edge with the leading side edges of alternate portions being spaced apart a predetermined distance along the axis.

Other features of the invention may be attained by providing a decorative garland of the type set forth, wherein the continuous web of material is arranged in a series of consecutive, longitudinal folds, with each fold including a longitudinal reach and a bend, with each reach extending generally transversely of the axis and having a leading side edge, the leading side edges of alternate reaches being spaced apart a predetermined distance along the axis, the web extending between the wires at alternate bends.

Still other features of the invention may be attained by providing a decorative garland of the type set forth, wherein the continuous web of material is arranged in a series of flattened, generally helical coils about the longitudinal axis, with the coils extending generally transversely of the axis and having a predetermined pitch longitudinally of the axis, the wires extending outside of the coils and respectively along opposite sides of the coils, so that the twisting of the wires causes the coils to be pinched together between the wires at the axis and twisted about the axis to form coil halves, such that each coil half is spaced rotationally about the axis at a predetermined angle from adjacent coil halves.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a side elevational view of a length of decorative garland in accordance with a first embodiment of the present invention;

FIG. 2 is a fragmentary top plan view of the materials of a section of the garland of FIG. 1, with ribbon webs coiled about rods and before any twist has been imparted thereto;

FIG. 3 is a perspective view of a length of decorative garland in accordance with a second embodiment of the invention;

FIG. 4 is a view similar to FIG. 3 of a third embodiment of the invention;

FIG. 5 is an enlarged, side elevational view of a portion of the decorative garland of FIG. 1; and FIG. 6 is a fragmentary plan view of a portion of a garland in accordance with a fourth embodiment of the invention.

DESCRIPTION OF THE PREFERRED EMBODIMENTS

Referring to FIG. 1, there is illustrated a decorative spiral garland, generally designated by the numeral 10, constructed in accordance with a first embodiment of the present invention. The garland 10 may be formed on a machine like that disclosed in copending U.S. application Ser. No. 09/447,038 filed Nov. 19, 1999 filed on even date herewith and entitled "Method and Apparatus for Making Spiral Garland," the disclosure of which is incorporated herein by reference, but could also be formed by other apparatus or by hand. Referring to FIG. 2, there is illustrated a pair of threaded rods 11 and 12 which are rotatable about their axes and form a part of the machine of the aforementioned copending application for forming the garland 10, illustrated herein to assist in understanding the method by which the garland 10 is formed, thereby to better understand its construction. The garland 10 is made up of a pair of core wires 13 and 14, a pair of filaments 15 and 16 and two continuous ribbon webs 20 and 30. Preferably, the webs 20 and 30 respectively have different visually distinguishable characteristics, indicated in the drawings by the stippling of the web 30, which characteristic could be color, texture, print design, or any of a number of other characteristics. Preferably, the webs 20 and 30 have the same width W.

The rods 11 and 12 form a framework around which the webs 20 and 30 are wound, respectively forming flattened, helical coils 21 and 31. The rotation and threading of the rods 11 and 12 is such as to advance the coils 21 and 31 to the right, as viewed in FIG. 2, new coils being added to the left of the figure. As can be seen, the coils 21 and 31 alternate, each having the same pitch P, which is approximately twice the web width W. In the illustrated embodiment there is a slight spacing between the coils, somewhat exaggerated in FIG. 2 to facilitate distinguishing the coils, so that the pitch P is slightly greater than 2W. While in the preferred embodiment, the pitch P is not less than 2W, it could be less than 2W, so that the coils overlap each other, or significantly greater than 2W so that adjacent coils are spaced farther apart, but in those cases the appearance of the finished garland would be different.

To assist in understanding the construction of the garland 10, a single "coil" of a ribbon web will be considered to be one 360° circuit around the rods 11 and 12. In this regard, it will be noted that the wires 13 and 14 lie along a central axis "X" midway between the rods 11 and 12 and substantially parallel thereto. Thus, for example, a single coil 21 of the web 20 may be considered to start at the axis X, go beneath and around the rod 11, over the rods 11 and 12, around and under the rod 12 and back to the axis X, at which point the next coil begins. Thus, for example, referring to the first coil 21 of the web 20, the coil has a lower outgoing portion or reach 22 ("outgoing" meaning radially outwardly from the axis X), a bend 23 around the rod 11, an upper incoming portion or reach 24 ("incoming" meaning radially inwardly toward the axis X), a portion 25 at the axis X which will later become a bend, as will be explained more fully below, an upper outgoing portion or reach 26, a bend 27 around the rod 12, and a lower incoming portion or reach 28. Similarly, the coil 31 of the web 30 has reaches 32, 34, 36 and 38 and bends 33, 35, and 37.

The coils 21 and 31, respectively, have leading side edges 29 and 39 in the direction of travel of coils along the rods 11 and 12, i.e., to the right in FIG. 2. Because of the helical nature of the coils, it will be appreciated that the leading side edges of adjacent coils of a web are spaced apart along the axis X by the distance of the pitch P. Thus, each of the reaches of a coil, e.g., reaches 24 and 26 of a coil 21, has a longitudinal axis Y, which is inclined to the axis X at a predetermined acute angle A. This angle will vary with the pitch P of the coils which, in turn, will vary with the number of webs used in the garland. In this regard, in the embodiments illustrated herein, the garland is made up of two ribbon webs 20, 30. However, it will be appreciated that the principles of the invention are applicable to garlands utilizing only a single web, in which the case the pitch P will be substantially W. It would also be possible to utilize more that two ribbon webs. It will further be appreciated that the pitch P will vary with the amount of overlap, if any, and the amount of spacing, if any, of adjacent coils. If adjacent coils overlap or are spaced apart, the pitch P will not be an integral multiple of W.

As was mentioned above, the wires 13 and 14 are laid along the axis X, the wire 13 being above the coils 21, 31, and the wire 14 being beneath the coils. The filaments 15, 16, on the other hand, pass inside the coils 21, 31. The wires 13, 14 are preferably formed of a suitable metal of a gauge preferably as small as possible in order to minimize cost and visibility in the finished product, but sufficiently large that it will retain its twisted configuration. The filaments 15, 16, could be monofilaments of a relatively clear plastic material to minimize visibility, or each could be formed of plural strands, such as a suitable yarn, if increased visibility is desired.

It is a fundamental aspect of the invention that the wires 13 and 14 are twisted together along the axis X. In the event that the garland is formed on the machine disclosed in the aforementioned copending application, the wires 13, 14 would be held at a location to the right of FIG. 2, while a twisting force would be applied to the wires at the left of FIG. 2, this force preferably being applied in the direction of the arrow in FIG. 2, although it could be applied in either direction. Since the coils 21 and 31 of the ribbon webs are disposed between the wires 13, 14, the twisting of the wires together also tends to twist the web coils. In the machine of the copending application, the twisting of the web coils is restrained by the rods 11, 12, until the coils come off the ends of the rods but, by the use of other apparatus, the twisting of the web coils could occur substantially simultaneously with the twisting of the wires. Preferably, the filaments 15, 16, are also held together with the wires at the right-hand holding point, so that the twisting serves to draw the filaments 15, 16 in toward the axis X and twist them together with the wires 13, 14.

In order to understand what happens to the web coils as the wires are twisted, it is helpful to think of the web coils 21, 31 as being, respectively, divided into half coils or loops 40, 50. For example one half coil or loop 40 of a coil 21 of the web 20 would include the reaches 22 and 24 and the intervening bend 23, while the other half coil or loop would comprise the reaches 26 and 28 and the intervening bend 27. In general, as the twisting progresses, the loops of a coil, in addition to rotating about the axis X, are folded toward each other about the axis X, forming the bends 25, 35. As will be explained more fully below, ultimately, if twisting is continued long enough, the loops will be folded completely together so that they are back-to-back, e.g., with the reach 24 contacting the reach 26, etc. In the resulting arrangement, each web may be viewed as made up of a series of consecutive folds back and forth between the axis X and a line radially spaced from the axis X. Each reach of a web has inner (at the axis X) and outer ends, respectively joined by bends to adjacent reaches, so that each web is formed of a series of consecutive folds, wherein each "fold" may be viewed as a reach and a bend which joins it to the next fold. For example, the web 20 includes a first fold having reach 22 and bend 23, a second fold having reach 24 and bend 25, a third fold having reach 26 and bend 27, a fourth fold having reach 28 and the next bend 25, and so forth.

As the wires 13, 14 are twisted together, the reaches 24 and 26 along the tops of the coils 21 fold toward each other around the wire 13 and, similarly, the reaches 34 and 36 of the web 30 fold toward each other around the wire 13. Simultaneously, the reach 28 of one coil 21 and the reach 22 of the next coil 21 along the bottoms of the coils fold toward each other around the wire 14. Similarly, the reaches 38 of the web 30 fold toward the reaches 32 of the next coils 31 around the wire 14. As this folding occurs, it can be seen that each bend 25 in the web 20 will be in engagement back-to-back with a bend 35 of the web 30, forming a line of engagement along the axis X, with the filaments 15 and 16 lying respectively on opposite sides of this line of engagement to facilitate in the creasing of the folds at the axis X.

Referring to FIG. 3, there is illustrated an embodiment of garland 10A which results after twisting of the wires 13, 14 through a predetermined number of twists, which number may vary depending upon the distance between the point at which the wires 13, 14 are held and the point at which the twisting force is imparted thereto. In the garland 10A consecutive loops 40 of the web 20 are rotationally spaced from each other about the axis X by a twist angle B, while consecutive loops 50 of the web 30 are similarly spaced. In the garland 10A, the angle B is substantially 90°, so that four consecutive loops 40A, 40B, 40C and 40D of the web 20 are arranged in a four-armed cross or star configuration, as are consecutive loops 50A, 50B, 50C and 50D of the web 30. Loops with the same letter suffix are axially aligned with each other so that the final garland 10A has a star or cross configuration. Furthermore, it can be seen that each loop 40 of the web 20 extends radially in a direction diametrically opposite a loop 50 of the web 30. For example loops 50A and 40C extend in opposite directions, loops 50B and 40D extend in opposite in opposite directions, and so forth. It can also be seen that alternate reaches of each web have leading side edges spaced apart at the axis X by a distance approximately equal to the web width W. For example the leading side edges 29 of reaches 22 and 26 are spaced apart at the axis X by a distance approximately equal to the width W. The spacing would be less or greater than W to the extent that there is any overlap or spacing of the webs.

If twisting is continued a predetermined number of twists beyond the configuration illustrated in FIG. 3, there will result another embodiment of the garland, designated by the numeral 10B, and illustrated in FIG. 4. In this embodiment, the adjacent loops of each web have continued to rotate about the axis X and have continued to fold closer to each other so that the angle B between adjacent loops of a web is now approximately 45°. Consecutive loops 40A through 40E and 50A through 50E are designated in the drawing. In this configuration, the consecutive loops of each web, if viewed from an end of the garland, would define generally an eight-armed star. It is also now more recognizable that the consecutive loops of each web define a helix or spiral about the axis X, the loops 40 forming a helix 45 and the loops 50 forming a helix 55, so that the garland 10B has a generally double-helix arrangement of web loops. Each loop 40 of web 20 continues to extend in a diametrically opposite direction from a loop 50 of web 30.

If twisting of the wires 13, 14 continues for a further predetermined number of twists beyond the configuration of FIG. 4, there will result the garland 10 of FIG. 1, also illustrated in FIG. 5. In the garland 10 adjacent loops of each web have been folded completely against each other, so that the angle B has become substantially zero. Thus, for example, the loop 40B of the web 20 is disposed in abutting back-to-back engagement with both the preceding loop 40A and the following loop 40C. Similarly, loop 50B is in abutting, back-to-back engagement with the preceding loop 50A and the following loop 50C of the web 30. As is best seen in FIG. 1, the helices 45 and 55, respectively formed by the loops of the web 20 and the loops of the web 30, have become tighter and more clearly defined.

The garland 10 is the most preferred embodiment, both because of this pleasing aesthetic appeal, and because of the fact that, by reason of the adjacent loops of each web being folded against each other, the wires 13, 14 are concealed. The filaments 15, 16 will, however, remain visible, assuming they are formed of a material designed to enhance visibility. In the garlands 10A and 10B of FIGS. 3 and 4, on the other hand, because adjacent loops of each web are still spaced from each other, the wires 13 and 14 are visible, which is normally less aesthetically desirable.

If twisting is continued a further predetermined number of twists beyond the configuration of FIG. 5 there will result a garland 10C, having the configuration illustrated in FIG. 6. The garland 10C differs from the garland 10 in that the helices 45 and 55 have essentially "unwound" or flattened out, so that all of the loops 40 and 50 lie generally parallel to a common plane, with all of the loops 40 of the web 20 on the one side of the axis X and all of the loops 50 of the web 30 on the opposite side of the axis X.

It will be appreciated that the amount of twist imparted to the garland is infinitely variable, but other variations are not illustrated, since they would not differ substantially in appearance from one of the illustrated embodiments. Furthermore, while in the preferred embodiment two filaments 15, 16 are utilized, the filaments are not essential and, if desired, either a single filament could be used or the filaments could be eliminated entirely.

As was indicated above, a garland in accordance with the present invention could be formed by utilizing a single ribbon web. Referring to the embodiment of FIG. 1, for example, a single-web garland could be formed which is very similar to the garland 10, except that one of the helices 45 or 55 would be eliminated. In such a single-web garland, there would be no need for two filaments and, therefore, either a single filament or no filament would be used. Variety could be introduced into a single-web garland by, for example, utilizing a ribbon web which has different visual characteristics on its opposite sides.

As was also indicated above, a garland in accordance with the present invention can be formed by utilizing more than two ribbon webs. In that case, the coils of the several webs would be arranged sequentially, and, if they are arranged side by side, with no overlap or spacing, the coils of each web would have a pitch substantially equal to NW, where N is the number of ribbon webs.

The foregoing description has assumed that, in garlands incorporating more than one ribbon web, each web has the same width. However, this need not be the case. Furthermore, the foregoing discussion has assumed that, in plural-web garlands, the webs would not completely overlap, but that also is not essential. For example, a narrow web could be wound directly on top of a wider web, resulting in a single-helix garland, as in the case of a single web, but with a striped effect, assuming the webs are visually distinguishable from each other, the nature of the striping depending upon where along the width of the wide web the narrow web is positioned.

From the foregoing, it can be seen that there has been provided an improved decorative garland which is of simple and economical construction, being formed of readily available commercial materials with no preprocessing, having a unique, aesthetically appealing appearance, which is capable of wide variation by varying a single parameter of the formation method.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A decorative garland comprising:

a pair of elongated core wires twisted together along a longitudinal axis, and a continuous web of material arranged in a series of consecutive portions extending longitudinally of the web with each portion inclined with respect to the axis at a predetermined acute angle, each portion having an inner end disposed adjacent to the axis and an outer end spaced radially from the axis, the web being disposed between the wires at each of the inner ends, each web portion having a leading side edge with the leading side edges of alternate portions being spaced apart a predetermined distance along the axis.

2. The garland of claim 1, wherein said portions of the web are arranged in pairs of adjacent portions joined at their outer ends.

3. The garland of claim 2, wherein each portion of each pair has its inner end joined to the inner end of a portion of an adjacent pair.

4. The garland of claim 2, wherein each portion of a pair is inclined at a predetermined twist angle with respect to a portion of an adjacent pair.

5. The garland of claim 4, wherein the twist angle is substantially 90°.

6. The garland of claim 4, wherein the twist angle is substantially less than 90°.

7. The garland of claim 2, wherein each portion is disposed in substantially back-to-back overlapping relationship with a portion of an adjacent pair.

8. The garland of claim 7, wherein consecutive pairs of portions are arranged in a spiral about the axis.

9. The garland of claim 1, wherein the web of material has a width, and the predetermined distance is not substantially greater than the width of the web.

10. The garland of claim 1, wherein the continuous web is a first web, and further comprising a second continuous web of material arranged in a series of consecutive portions each inclined with respect to the axis at a predetermined acute angle, each portion of the second web having an inner end disposed adjacent to the axis and an outer end spaced radially from the axis, the second web being disposed between the wires at each of its inner ends, each web portion of the second web having a leading side edge with the leading side edges of alternate portions of the second web being spaced apart a predetermined distance along the axis.

11. The garland of claim 10, wherein said portions of said first web are arranged in pairs of adjacent portions joined at their outer ends, and said portions of said second web are arranged in pairs of adjacent portions joined at their outer ends.

12. The garland of claim 11, wherein each portion of a pair of said first web is inclined at a first predetermined twist angle with respect to a portion of an adjacent pair of the first web, and each portion of a pair of the second web is inclined at a second predetermined twist angle with respect to a portion of an adjacent pair of the second web.

13. The garland of claim 12, wherein the first and second predetermined twist angles are the same.

14. The garland of claim 13, wherein each of the first and second predetermined twist angles is substantially 90°.

15. The garland of claim 13, wherein each of the first and second predetermined twist angles is substantially less than 90°.

16. The garland of claim 12, wherein each portion of the first web is disposed in substantially back-to-back overlapping relationship with a portion of an adjacent pair of the first web, and each portion of the second is disposed in substantially back-to-back overlapping relationship with a portion of an adjacent pair of the second web.

17. The garland of claim 16, wherein consecutive pairs of portions of the first web are arranged in a first spiral about the axis, and consecutive pairs of portions of the second web are arranged in a second spiral about the axis, the first and second spirals being substantially 180° out of phase with each other.

18. The garland of claim 11, wherein each pair of portions of the first web extends from the axis in a diametrically opposite direction from a pair of portions of the second web.

19. The garland of claim 10, wherein said webs are respectively ribbons having different visually distinguishable characteristics.

20. The garland of claim 1, and further comprising at least one filament extending along the axis and twisted together with the wires.

21. The garland of claim 20, wherein the number of filaments is two.

22. The garland of claim 1, wherein said web is a ribbon.

23. A decorative garland comprising:

a pair of elongated core wires twisted together along a longitudinal axis, and a continuous web of material arranged in a series of consecutive longitudinal folds with each fold including a longitudinal reach and a bend, with each reach extending generally transversely of the axis and having a leading side edge, the leading side edges of alternate reaches being spaced apart a predetermined distance along the axis, the web extending between the wires at alternate bends.

24. The garland of claim 23, wherein said folds are arranged in pairs of folds joined at bends spaced from the axis so that each pair of folds forms a loop, each reach of a loop being inclined at a predetermined twist angle with respect to a reach of an adjacent loop.

25. The garland of claim 24, wherein consecutive loops are arranged in a spiral about the axis.

26. The garland of claim 23, wherein the web of material has a width, and said predetermined distance being approximately equal to said width.

27. The garland of claim 23, wherein said continuous web is a first web, and further comprising a second continuous web of material arranged in a series of consecutive folds with each fold including a reach and a bend, with each reach of the second web extending generally transversely of the axis and having a leading side edge, the leading side edges of alternate reaches of the second web being spaced apart the predetermined distance along the axis, the second web extending between the wires at alternate bends of the second web.

28. The garland of claim 23, and further comprising at least one filament extending along the axis and twisted together with the wires.

29. A decorative garland comprising:

a continuous web of material arranged in a series of flattened, generally helical coils about a longitudinal axis with the coils extending generally transversely of the axis and having a predetermined pitch longitudinally of the axis, and a pair of wires extending generally parallel to the axis outside of the coils and respectively along opposite sides of the coils, the wires being twisted together along the axis, so that the coils are pinched together between the wires at the axis and twisted about the axis to form coil halves or loops such that each loop is spaced rotationally about the axis at a predetermined twist angle from adjacent loops.

30. The garland of claim 29, wherein the continuous web is a first web, and further comprising a second continuous web of material arranged in a series of flattened, generally helical coils about the axis with the coils extending generally transversely of the axis and having the predetermined pitch longitudinally of the axis, the coils of the second web alternating with the coils of the first web so that the coils of both webs are pinched together between the wires at the axis and twisted about the axis to form coil halves or loops of the first web and coil halves or loops of the second web such that each loop is spaced rotationally about the axis at a predetermined twist angle from adjacent loops of the same web.

31. The garland of claim 29, and further comprising at least one filament extending along the axis and twisted together with the wires.

32. The garland of claim 29, wherein the continuous web is a first web having a width W, and further comprising at least one additional continuous web so that the total number of first and additional webs is N, each additional web having a width W and being arranged in a series of flattened, generally helical coils about the axis with the coils extending generally transversely of the axis and having the predetermined pitch longitudinally of the axis, the coils of the webs being sequentially arranged so that the webs form adjacent helices and the coils of the webs are pinched together between the wires at the axis and twisted about the axis to form coil halves or loops for each web such that each loop is spaced rotationally about the axis at the predetermined twist angle from adjacent loops of the same web.

33. The garland of claim 32, wherein N is 2.

* * * * *